US011052437B2

(12) United States Patent
Gromes, Sr. et al.

(10) Patent No.: US 11,052,437 B2
(45) Date of Patent: Jul. 6, 2021

(54) REACTION FORCE NOZZLE

(71) Applicant: Terydon, Inc., Navarre, OH (US)

(72) Inventors: Terry D. Gromes, Sr., Navarre, OH (US); Gary L. Manack, Jr., Navarre, OH (US); Kristen E. Gromes, Navarre, OH (US)

(73) Assignee: TERYDON, INC., Navarre, OH (US)

( * ) Notice: Subject to any disclaimer, the term of this patent is extended or adjusted under 35 U.S.C. 154(b) by 252 days.

(21) Appl. No.: 16/513,812

(22) Filed: Jul. 17, 2019

(65) Prior Publication Data

US 2019/0337028 A1 Nov. 7, 2019

Related U.S. Application Data

(62) Division of application No. 15/876,415, filed on Jan. 22, 2018, now Pat. No. 10,399,129.

(51) Int. Cl.

| | |
|---|---|
| ***B08B 9/032*** | (2006.01) |
| ***B05B 1/16*** | (2006.01) |
| ***B08B 3/02*** | (2006.01) |
| ***B05B 15/52*** | (2018.01) |
| ***B05B 1/34*** | (2006.01) |
| ***B08B 9/043*** | (2006.01) |

(52) U.S. Cl.

CPC ..... *B08B 9/0321* (2013.01); *B05B 1/1636* (2013.01); *B05B 1/3436* (2013.01); *B05B 15/52* (2018.02); *B08B 3/02* (2013.01); *B08B 9/0436* (2013.01); *B08B 2209/032* (2013.01); *B08B 2209/045* (2013.01)

(58) Field of Classification Search

CPC ..... B08B 3/02; B08B 9/0436; B08B 9/0321; B08B 2209/032; B08B 2209/045; B05B 15/52; B05B 1/1636; B05B 1/3436

See application file for complete search history.

(56) References Cited

U.S. PATENT DOCUMENTS

| | | | | |
|---|---|---|---|---|
| 3,234,580 A | | 2/1966 | Keck | |
| 3,876,154 A | | 4/1975 | Griebel | |
| 4,531,250 A | | 7/1985 | Watanabe | |
| 5,052,624 A | * | 10/1991 | Boers | B08B 3/028 239/525 |
| 5,312,049 A | * | 5/1994 | Bayler | B05B 1/32 239/578 |

(Continued)

*Primary Examiner* — Benjamin L Osterhout

(74) *Attorney, Agent, or Firm* — Sand, Sebolt & Wernow Co., LPA

(57) ABSTRACT

A nozzle for water jet equipment and a method of use thereof. The nozzle has a body including a base with a shaft extending outwardly therefrom. The shaft is inserted through a bore of a sleeve that rotatable about the shaft. The base and shaft define a bore therein. At least one opening is defined in the shaft and one or more grooves are milled into the shaft's exterior surface. Each opening places the body's bore in fluid communication with one of the grooves and the sleeve's bore. Water flowing through the body's bore will flow through each opening, into the associated groove and into a space between the shaft and sleeve. The grooves create turbulence in water in this space and thereby reduce leakage from the nozzle. The shaft terminates in a conical section usable as a battering ram to break up blockages in pipes during cleaning operations.

20 Claims, 17 Drawing Sheets

(56) References Cited

U.S. PATENT DOCUMENTS

| | | | | |
|---|---|---|---|---|
| 5,865,876 | A * | 2/1999 | Watkins | C21C 5/4693 75/548 |
| 5,909,848 | A * | 6/1999 | Zink | B05B 3/001 239/252 |
| 5,964,414 | A * | 10/1999 | Hardy | B05B 3/005 239/252 |
| 6,059,202 | A * | 5/2000 | Zink | B05B 3/026 239/259 |
| 6,672,257 | B1 * | 1/2004 | Ashton, III | F22B 37/483 122/379 |
| 6,840,315 | B2 | 1/2005 | Jarchau et al. | |
| 7,380,731 | B1 | 6/2008 | Hsu | |
| 2004/0050955 | A1 | 3/2004 | Sesser et al. | |
| 2008/0142620 | A1 * | 6/2008 | Scheidt | B05B 1/3436 239/490 |
| 2015/0075573 | A1 * | 3/2015 | Hirasaka | B23Q 5/04 134/172 |
| 2020/0206790 | A1 | 7/2020 | Gromes, Sr. et al. | |

* cited by examiner

REACTION FORCE NOZZLE

CROSS-REFERENCE TO RELATED APPLICATIONS

This application is a Divisional of U.S. patent application Ser. No. 15/876,415 filed Jan. 22, 2018, the entire disclosure of which is incorporated herein by reference.

BACKGROUND

Technical Field

The present disclosure relates to water jet equipment. More particularly the disclosure is directed to a nozzle for water jet equipment. Specifically, the disclosure relates to a nozzle for water jet equipment and a method of using the same; where the nozzle includes a body with a shaft and a sleeve that rotates about the shaft, and where the shaft has one or more grooves milled into the shaft's exterior surface; and where the grooves create turbulence in water that moves into a space between the shaft and the sleeve and slows leakage from the nozzle.

Background Information

Heat exchangers are used to transfer heat from a solid object to a fluid or from one fluid to another fluid. The heat exchanger will include a plurality of elongate tubes that carry steam or water. Over time, solid materials tend to become deposited on the interior surfaces of these tubes and the solid materials may eventually become thick enough to clog the tubes.

It is therefore customary to clean the tubes from time to time. This cleaning is typically accomplished using a water jet to blast away the deposited solid materials. A lance or washer arm having a nozzle at one end is inserted into each tube and a water jet is sprayed out of the nozzle to blast away the clog or blockage.

The nozzles in question typically include a stationary part and a sleeve that rotates about this stationary part. The problem with this cleaning equipment is that because the water is delivered to the nozzle under extremely high pressure, there is a tendency for water to leak out of the top and bottom ends of the rotating sleeve. While the leaking water creates a water bearing that helps the sleeve to rotate, the rate of water leakage in PRIOR ART nozzles may be upwards of about eight gallons per minute. This leakage makes the nozzles far less efficient than desirable and also wastes a considerable amount of water.

The other issue with this cleaning equipment is that as the nozzle comes into contact with deposited material as those deposits are removed from the interior of the tube, some of the particulate materials can become trapped between the rotating sleeve and the stationary part of the nozzle and hinder or even stop the rotation of the sleeve. This can result in damage to the nozzle as water continues to be delivered under high pressure to the nozzle.

SUMMARY

There is therefore a need in the art for an improved nozzle that leaks to a lesser degree and which has a reduced tendency to become blocked. The nozzle disclosed herein addresses these shortcomings of the prior art.

A nozzle for water jet equipment and a method of use thereof is disclosed herein. The nozzle has a body including a base with a shaft extending outwardly therefrom. The shaft is inserted through a bore of a sleeve that rotatable about the shaft. The base and shaft define a bore therein. At least one opening is defined in the shaft and one or more grooves are milled into the shaft's exterior surface. Each opening places the body's bore in fluid communication with one of the grooves and the sleeve's bore. Water flowing through the body's bore will flow through each opening, into the associated groove and into a space between the shaft and sleeve. The grooves create turbulence in water in this space and thereby reduce leakage from the nozzle. The shaft terminates in a conical section usable as a battering ram to break up blockages in pipes during cleaning operations.

In one aspect, the present disclosure may provide a nozzle for engagement with a washing arm; said nozzle comprising a body comprising a base having a first end and a second end and having a longitudinal axis extending therebetween; said second end of the base being adapted to be engaged with an end of a washing arm; a shaft having a first section that extends longitudinally outwardly from the first end of the base; and a sleeve mounted for rotation about the first section of the shaft; wherein the base defines a bore that originates in the second end and extends for a distance within the first section of the shaft; wherein the exterior surface of the first section of the shaft defines at least one opening therein that is in fluid communication with the bore; and wherein the exterior surface of the first section of the shaft defines one or more grooves therein and the at least one opening is in fluid communication with one of the one or more grooves.

In another aspect, the present disclosure may provide a method of slowing leakage from a nozzle provided on a washing arm of water jet equipment; said method comprising providing a nozzle comprising a body having a base with a first end and a second end and a longitudinal axis extending therebetween; a shaft having a first section that extends longitudinally outwardly from the first end of the base; and a sleeve mounted for rotation about the first section of the shaft; wherein the base defines a bore that originates in the second end and extends for a distance within the first section of the shaft; wherein the exterior surface of the first section of the shaft defines at least one opening therein that is in fluid communication with the bore; and wherein the exterior surface of the first section of the shaft defines one or more grooves therein and the at least one opening is in fluid communication with one of the one or more grooves; engaging the second end of the base with an end of the washing arm; connecting the washing arm to a remote water source; causing a quantity of water to flow through the bore of the base; through the at least one opening; into the one or more grooves and into a space defined between the exterior surface of the shaft and an interior surface of the sleeve; and creating turbulence in the water that is located in the space between the exterior surface of the shaft and the interior surface of the sleeve.

In another aspect, the present method may provide defining a bore in the sleeve and defining one or more openings in the sleeve that extend from an exterior surface of the sleeve to the sleeve's bore; inserting the first region of the shaft through the sleeve's bore; placing the space between the shaft and the sleeve in fluid communication with the one or more openings in the sleeve; and causing at least some of the water that is located in the space between the exterior surface of the shaft and the interior surface of the sleeve to flow out of the one or more openings.

In another aspect, the present method may include trapping particulate material entrained in the water in the one or more grooves. In some embodiments the method may further comprise expelling particulate material entrained in the water through the one or more openings in the sleeve.

In yet another aspect, the present disclosure may provide a method of cleaning an interior of a pipe using water jet equipment; said method comprising providing a nozzle comprising a body having a base with a first end and a second end and a longitudinal axis extending therebetween; a shaft having a first section that extends longitudinally outwardly from the first end of the base; and a sleeve mounted for rotation about the first section of the shaft; engaging the second end of the base with an end of the washing arm; connecting the washing arm to a remote water source; defining a first end aperture, a second end aperture and a third end aperture in a first end of the sleeve; placing the first end aperture, the second end aperture and the third end aperture in fluid communication with a bore defined by the sleeve; directing water outward from the first end aperture, the second end aperture and the third end aperture; and clearing away clogged material from the interior of the pipe using the water directed out of the first end aperture, second end aperture and third end aperture.

In some embodiments the method may include contacting the clogged material with a tip of the shaft; breaking up at least some of the clogged material with the tip to form broken-up material; and clearing away the broken-up material with the water directed out of the first end aperture, the second end aperture, and the third end aperture.

In other embodiments, the method may include directing water outward from the first end aperture and outwardly beyond an exterior surface of the sleeve; directing water outward from the second end aperture and inwardly toward an end of the shaft that projects outwardly from a first end of the sleeve; and directing water outward from the third end aperture and outwardly beyond the exterior surface of the sleeve. The method may further include rotating the sleeve about the shaft by directing water outward from the third end aperture.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
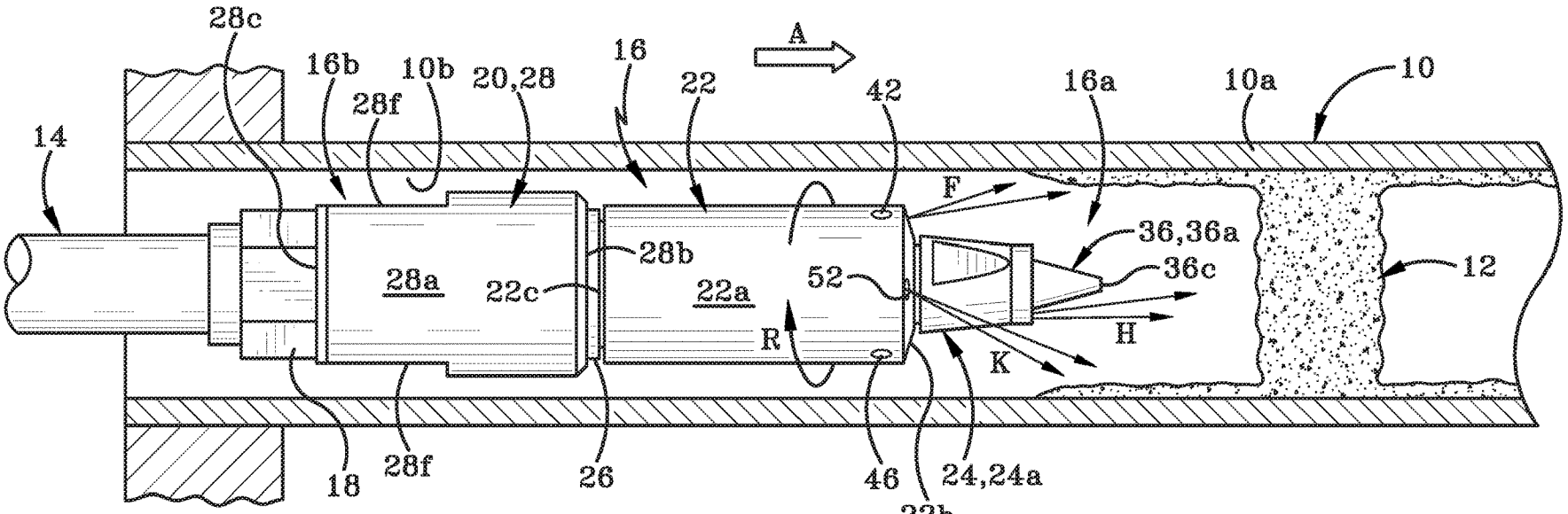
FIG. 1 is a front elevation view of a nozzle for water jet equipment in accordance with the present disclosure where the nozzle is shown traveling through a clogged pipe.

Referring to FIG. 1 there is shown a tube 10 having an exterior circumferential wall 10*a* that bounds and defines an interior bore 10*b*. Tube 10 is provided as a path for a fluid to flow through bore 10*b*. As illustrated in this figure, a blockage or clog 12 has formed across the tube 10. Clog 12 may be comprised of materials that have been dropped by the fluid flowing through bore 10*b* or that have precipitated from the fluid flowing through bore 10*b* and deposited on the interior surface of the wall 10*a*. Clog 12 is illustrated as entirely blocking bore 10*b* but it will be understood that clog 12 might in other instances only partially block bore 10*b*.

A washing arm 14 having a nozzle 16, in accordance with the present disclosure, has been introduced into bore 10*b* to remove clog 12. Washing arm 14 may comprise part of a lance or hose or any other piece of equipment that is selectively insertable into a heat exchanger tube to direct a water jet into the same for cleaning purposes. Washing arm 14 may be selectively moved into an out of a heat exchanger tube during the cleaning operation.

Nozzle 16 has a leading end 16*a* and a trailing end 16*b*. The trailing end 16*b* of nozzle 16 is illustrated as being fixedly engaged with a front end 14*a* of washing arm 14 by way of any suitable pressure fitting 18. It will be understood that washing arm 14 defines a hollow bore therethrough and that washing arm 14 is connected to a remote water supply. Water is delivered via the bore of washing arm 14 to nozzle 16. FIG. 1 shows water being sprayed out of outlets provided proximate the leading end 16*a* of nozzle 16. The sprayed water is directed in a number of different directions (which will be discussed later herein) in order to entirely remove clog 12 from bore 10*b* of tube 10. Nozzle 16 and washing arm 14 is moved in the direction of arrow "A" through bore 10*b* and toward clog 12.

Figure 2:
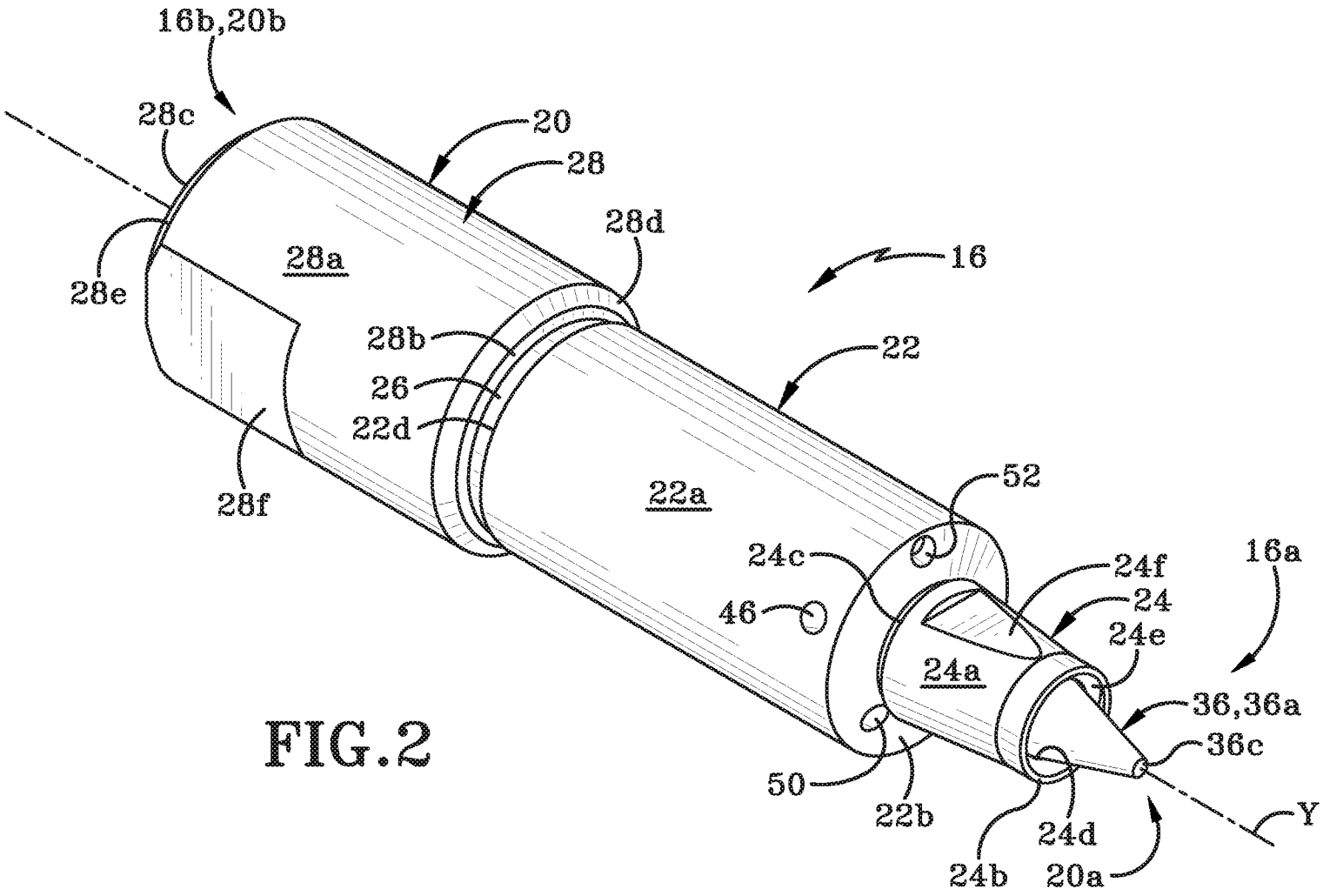
FIG. 2 is a front perspective view of the nozzle in accordance with the present disclosure.
Figure 3:
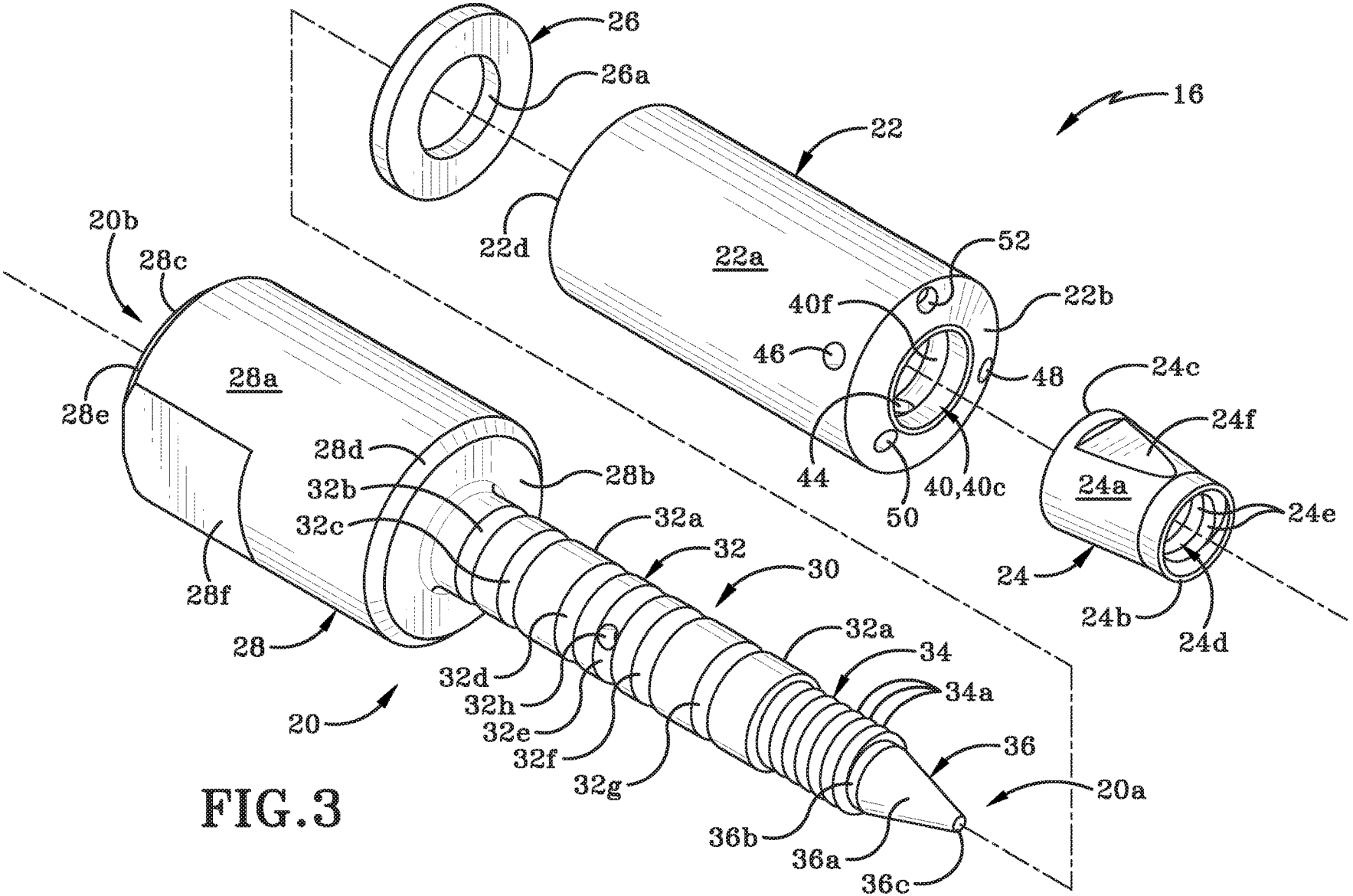
FIG. 3 is an exploded front perspective view of the nozzle.

Referring to FIGS. 2 and 3, nozzle 16 comprises a body 20, a sleeve 22, a nose cone 24, and a washer 26. Body 20 has a leading end 20*a* and a trailing end 20*b*. The leading end 20*a* of body 20 forms the leading end 16*a* of nozzle 16 and the trailing end 20*b* of body 20 forms the trailing end 16*b* of nozzle 16.

Figure 4:
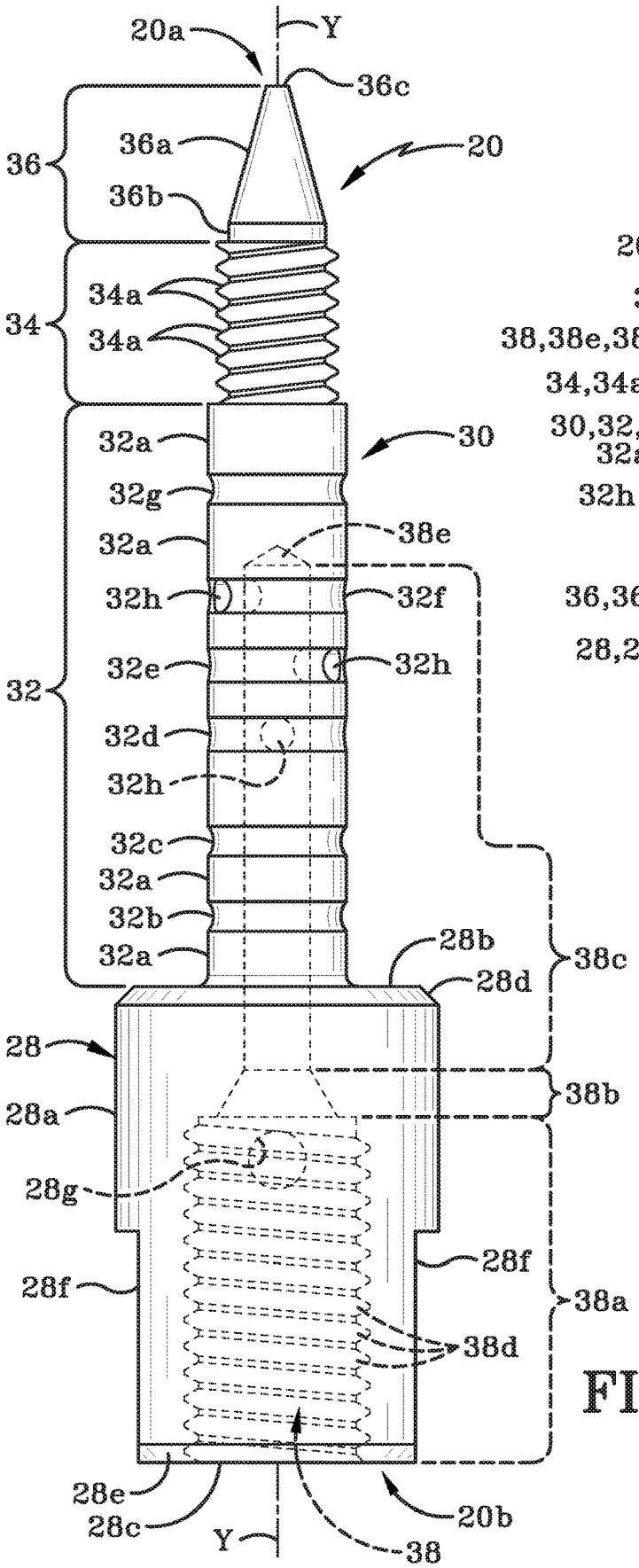
FIG. 4 is a front elevation view of the nozzle.
Figure 5:
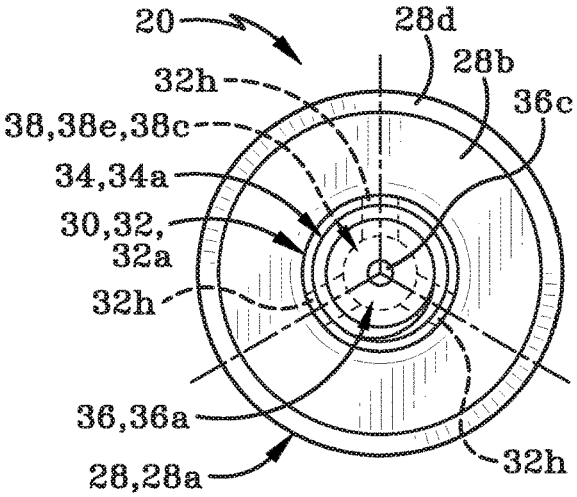
FIG. 5 is a top plan view of the nozzle.
Figure 6:
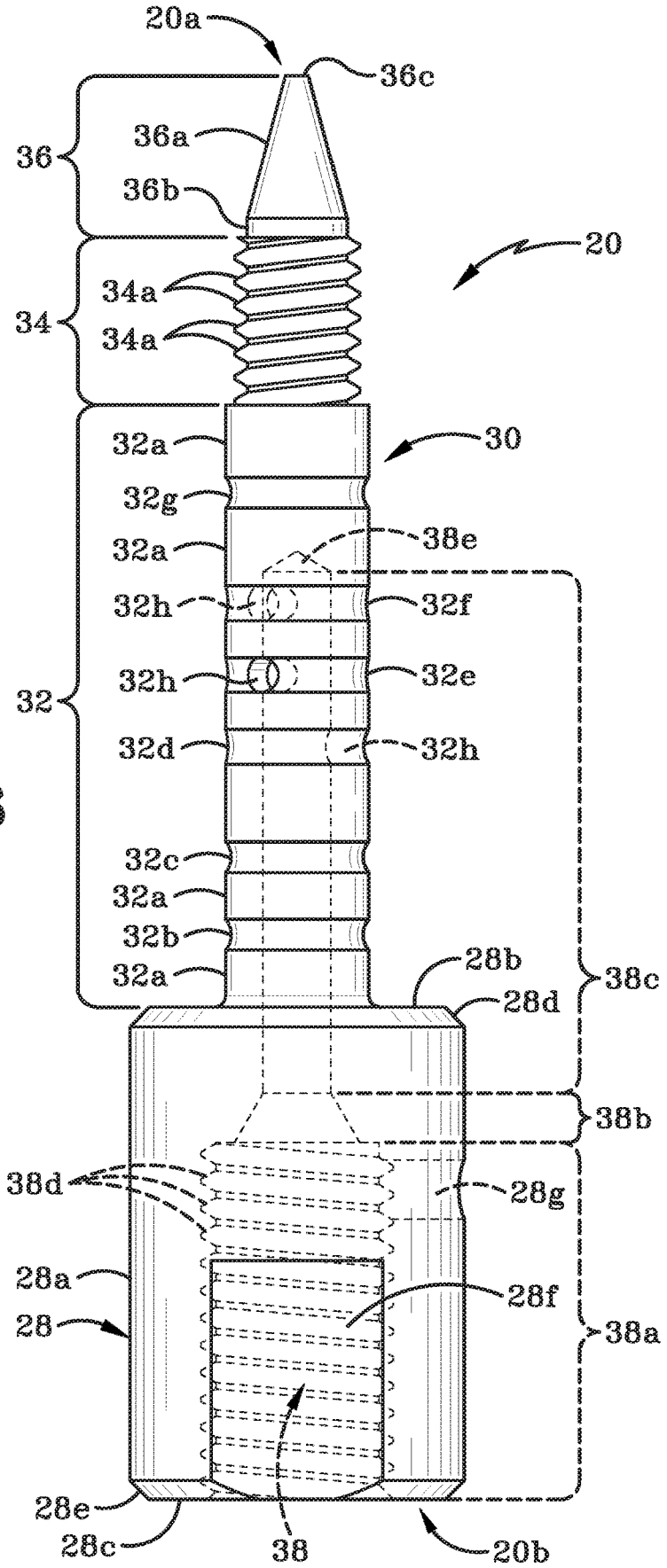
FIG. 6 is a rear elevation view of the nozzle.
Figure 7:
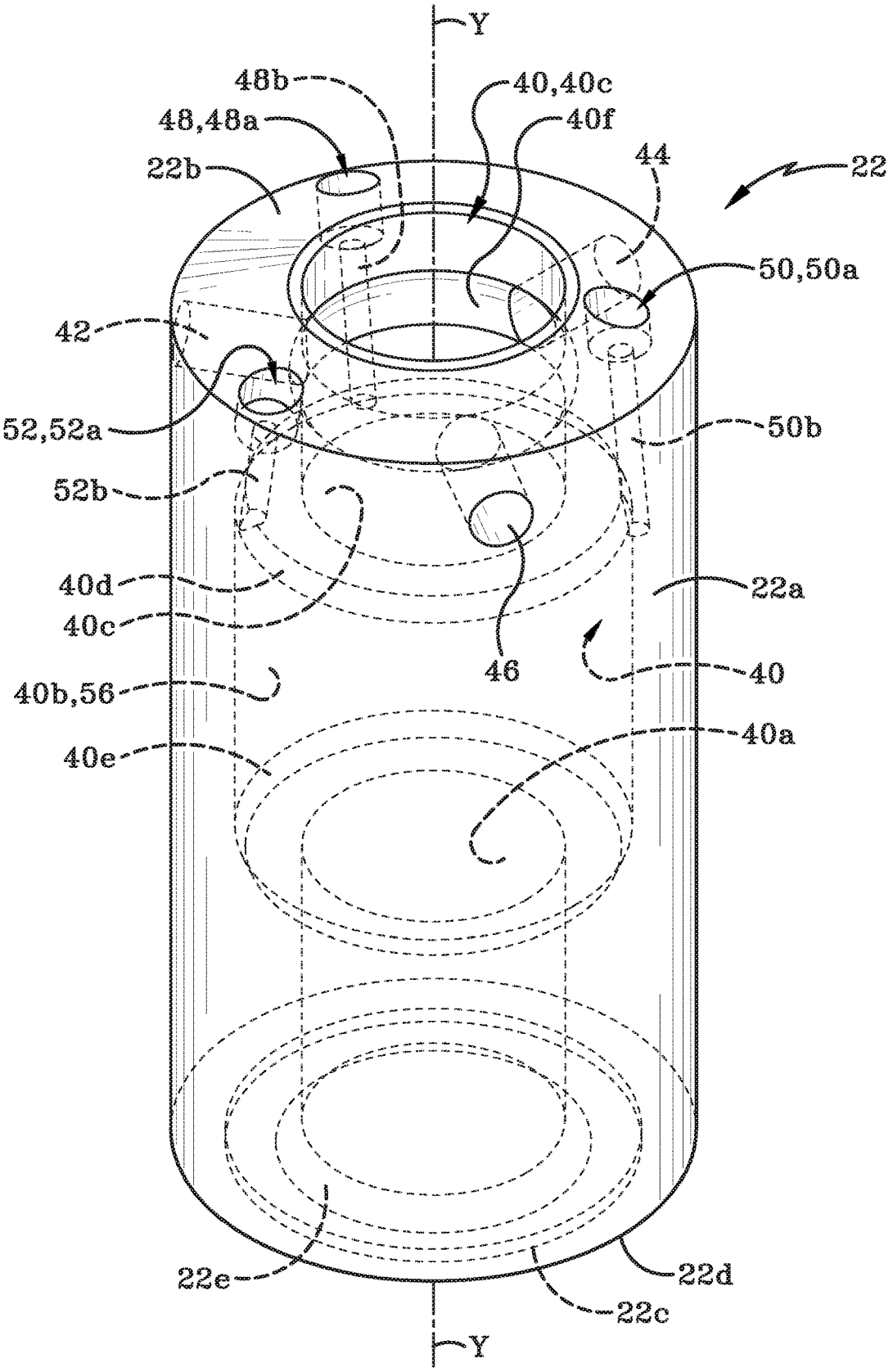
FIG. 7 is a top perspective view of a sleeve shown on its own.

Referring to FIGS. 2-6, body 20 comprises a generally cylindrical base 28 and an aperture 30 that extends outwardly from base 28. Base 28 includes a generally cylindrical outer wall 28*a* that has a first end wall 28*b* and an opposed second end wall 28*c*. An annular first chamfered surface 28*d* extends between outer wall 28*a* and first end wall 28*b*. A second chamfered surface 28*e* extends between outer wall 28*a* and second end wall 28*c*. A pair of notched regions 28*f* is formed in the cylindrical outer wall 28*a*. The notched regions 28*f* (FIGS. 4 and 5) are opposed to each other and are recessed relative to the rest of outer wall 28*a*. Instead of being curved like the rest of outer wall 28*a*, notched regions 28*f* are generally flattened or planar. Each notched region 28*f* originates in second end wall 28*c*, extends through second chamfered region 28*e*, and extends for a distance upwardly along outer wall 28*a*. Notched regions 28*f* are generally parallel to a longitudinal axis "Y" (FIG. 6) of body 20, where the longitudinal axis "Y" extends from first end 20*a* to second end 20*b*. As shown in FIG. 4, and FIG. 6, a weep hole 28*g* is defined in base 28. Weep hole 28*g* extends from a bore 38 defined in body 20 to an opening defined in outer wall 28*a*. Weep hole 28*g* allows water to escape from the region of bore 38 into which washing arm 14 is threadably engaged.

Body 20 may be a single, monolithic, unitary part that is integrally formed from a material such as stainless steel. Aperture 30 is integrally formed with base 28 and extends outwardly from first end wall 28*b* in a direction substantially parallel to longitudinal axis "Y". Aperture 30 is concentric with the un-notched portion of the outer wall 28*a* of base 28. Aperture 30 is of a reduced diameter relative to outer wall 28*a*.

As shown in FIG. 4, aperture 30 has a number of distinct regions 32, 34 and 36. First section 32 extends longitudinally outwardly from first end 28*b* of base 28; second section 34 extends longitudinally outwardly from first section 32 and third section 36 extends longitudinally outwardly from second section 34. First section 32 is of a greater diameter than second section 34 or third section 36. Second section 34 is of a greater diameter than third section 36.

First section 32 of aperture 30 includes an exterior surface 32*a* in which a plurality of spaced-apart grooves 32*b*, 32*c*, 32*d*, 32*e*, 32*f*, and 32*g* are formed. Each of the grooves 32*b*, 32*c*, 32*d*, 32*e*, 32*f* and 32*g* may be concave and have an arcuate curvature. For example, each groove 32*b*-32*g* may be of a shallow C-shape. Grooves 32*b* may be annular (i.e., extending around the entire circumference of shaft 30) or grooves 32*b* may comprise a plurality of aligned but spaced apart curved sections. Grooves 32*b*-32*g* in one embodiment may be oriented at right angles to longitudinal axis "Y" of body 20. In other embodiments, grooves 32*b*-32*g* may be oriented at an angle other than ninety degrees relative to longitudinal axis "Y". It will be understood that while aperture 30 has been illustrated has having six grooves, fewer than six grooves or more than six grooves may be formed in the exterior surface 32*a* of first section 32. Grooves 32*b*-32*g* may all be of generally the same depth and curvature relative to each other and to the rest of the exterior surface 32*a* of first section 32. In other embodiments the grooves 32*b*-32*g* may be of different depths and curvatures relative to each other. The distances between grooves that are adjacent to each other (i.e., next to each other along the length of first section 32 may vary. For example, the distance between groove 32*b* and 32*c* is smaller than the distance between groove 32*c* and groove 32*d*. In other embodiments the grooves 32*b*-32*g* may be equidistantly spaced from each other.

One or more apertures 32*h* are defined in the exterior wall 32*a* of first section 32 of aperture 30. Each aperture 32*h* preferably originates in one of the groove 32*b*-32*g* and extends inwardly toward a center of first region. Apertures 32*h* may be oriented at right angles to longitudinal axis "Y". The purpose of apertures 32*h* will be later described herein.

Second section 34 of shaft 30 includes an exterior surface in which a plurality of threads 34*a* is formed. Third section 36 is a truncated conical shape and has a substantially smooth exterior surface 36*a* that tapers in diameter from a collar 36*b* to a blunt tip 36*c*. Tip 36*c* does not include any apertures therein. Instead, all of third section 36 may be substantially solid. This conical third section 36 is provided on the end of shaft 30 so that it is positioned to run into a clog or blockage 12 in tube 10 before any of the rest of nozzle (particularly before the rotating sleeve 22) contacts that clog 12. The tip 36*c* hits the clog 12 as washing arm 14 is moved in the direction of arrow "A" (FIG. 1) and tip 36*c* helps to break up and break through clog 12 so that the material from clog 12 may be removed by water spraying out of nozzle 16. The tapered smooth sides of third section 36 helps nozzle move forward through a clogged region in tube 10 more easily than if the surface of third section 36 was textured. The angle on smooth surface 36*a* also helps removed material to be directed away from the region where shaft 30 exits sleeve 22 and where that removed material might otherwise get trapped between sleeve 22 and shaft 30 and stop sleeve 22 from rotating. If second and third regions 34, 36 of shaft 30 were not provided, the sleeve 22 on the nozzle would directly contact clog 12 and might stop rotating and thereby stop cleaning out clog 12. Third section 36 therefore helps sleeve 22 to continue to spin.

Figure 10:
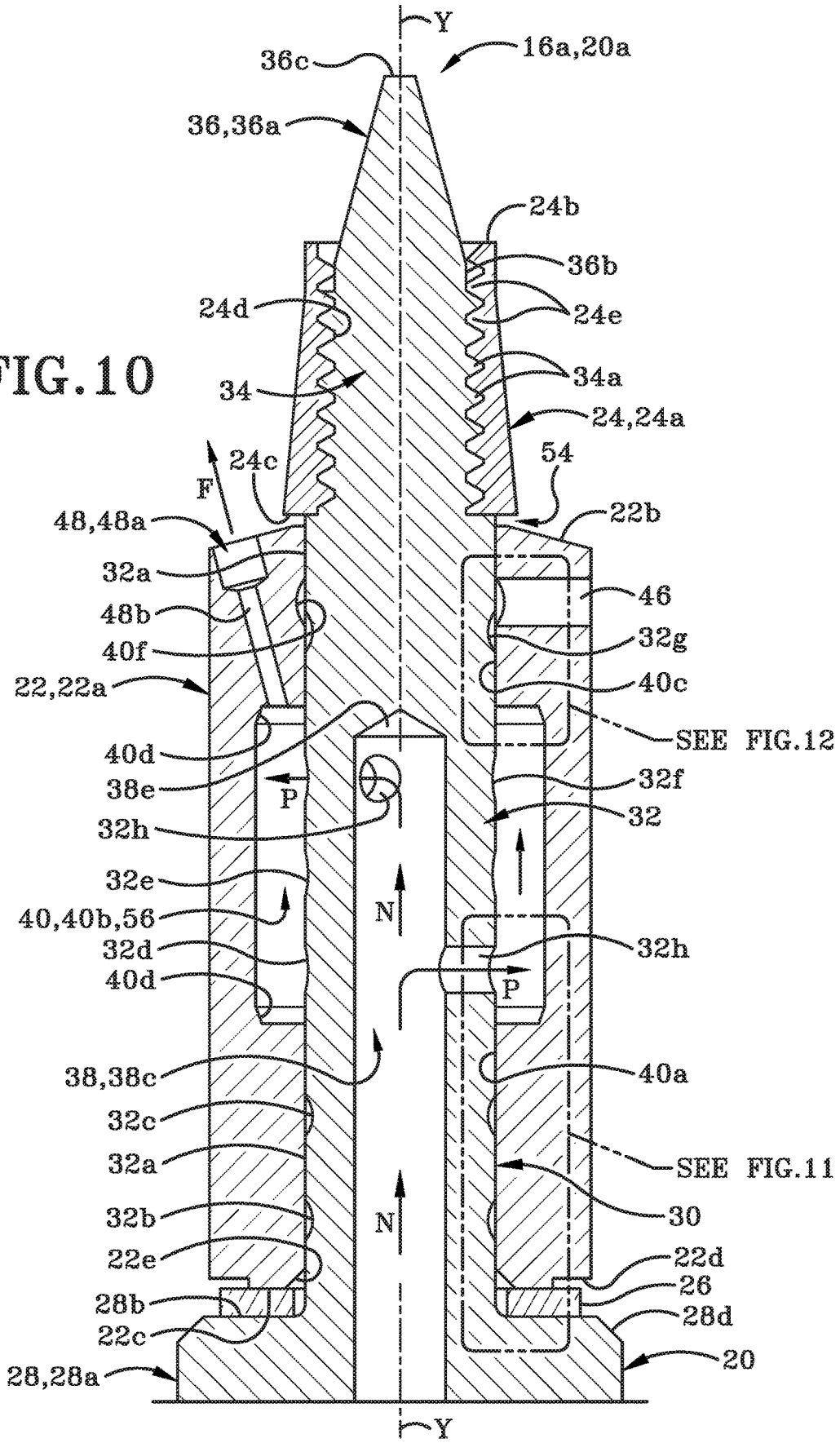
FIG. 10 is a longitudinal cross-section of the nozzle taken along line 10-10 of FIG. 1.

FIGS. 4, 5 and 10 show that body 20 defines an interior bore 38 therein. Bore 38 originates in second end wall 28*c* of base 28 and extends longitudinally inwardly to a terminal end that is located within the length of first section 32 of shaft 30. FIG. 4 shows that bore 38 defined in base 28 comprises three regions 38*a*, 38*b* and 38*c* that are of different diameters. First region 38*a* originates in second end wall 28*c* of base 28 and extends for a distance longitudinally beyond an upper part of notches 28*f*. First region 38*a* terminates a distance inwardly from first end wall 28*b*. First region 38*a* is formed so that the interior surface of body 20 that defines first region 38*a* is internally threaded with threads 38*d*. Second region 38*b* of bore tapers in diameter from the end of first region 38*a* to the beginning of third region 38*c*. Third region 38*c* is of a substantially constant diameter (that is less than the diameter of first region 38*a* and second region 38*b*) until proximate a terminal end 38*e*. Terminal end 38*e* of third region 38*c* is substantially conical. Each of the aperture 32*h* defined in the exterior wall 32*a* of first section 32 of shaft 30 terminates in bore 38. Consequently bore 38 and apertures 32*h* are in fluid communication and water flowing through bore 38 will flow out of apertures 32*h* and into the associated grooves 32*b*-32*g* and then outwardly therefrom. When nozzle 16 is engaged with water supply arm 14, an externally threaded portion of the supply arm 14 will be inserted into first region 38*a* of bore 38 and will be threadably engaged with body 20.

Referring to FIGS. 3 and 7-9C, sleeve 22 is shown in greater detail. Sleeve 22 is configured to be received around an exterior portion of shaft 30 of body 20. In particular, sleeve 22 is received around the first section 32 of shaft 30 in such a way that sleeve 22 will rotate about the exterior surface of first section 32 and thereby around longitudinal axis "Y" of body 20.

Figure 8:
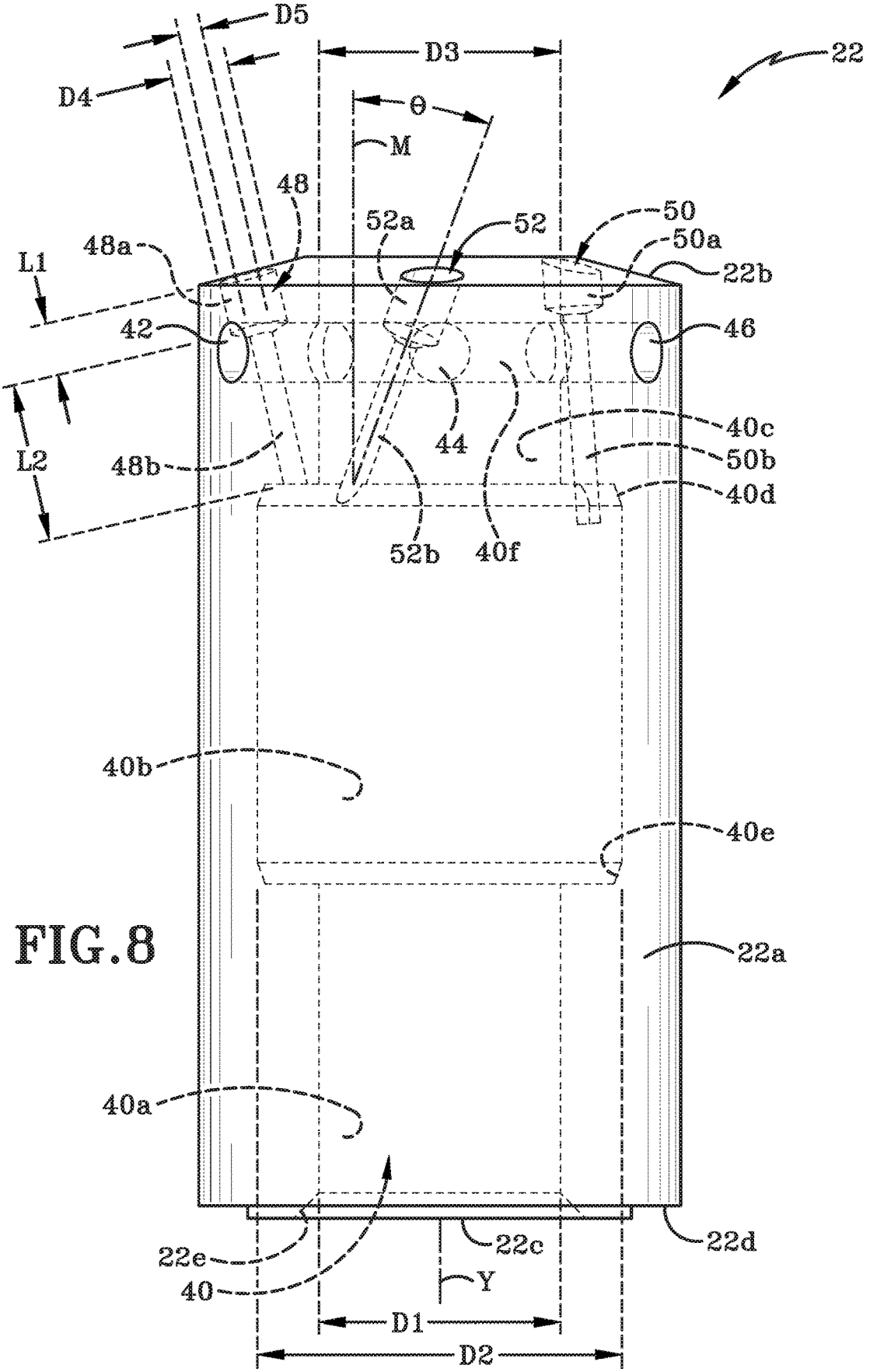
FIG. 8 is a front elevation view of the sleeve of FIG. 7.

Referring to FIGS. 7-9C, sleeve 22 is a tubular member comprising a cylindrical outer wall 22*a* that has a first end wall 22*b* at a first end and a second end wall 22*c* at a second end. Sleeve 22 defines a bore 40 therethrough. Bore 40 extends from an opening in first end wall 22*b* through to an opening in second end wall 22*c*. Referring to FIG. 8, bore 40 comprises a first region 40*a* of a first diameter "D1", a second region 40*b* of a second diameter "D2", and a third region 40*c* of the first diameter "D1". The first diameter "D1" approximate the size of the external diameter of the first region of the shaft 30. Second region 40*b* has a first chamfered surface 40*d* at a top end thereof (i.e., proximate third region 40*c*) and a second chamfered surface 40*e* at a bottom end thereof (i.e., proximate first region 40*a*). First and second chamfered surfaces 40*d*, 40*e* help strengthen sleeve 22. Diameter "D1" of first region 40*a* and third region 40*c* may be slightly larger than the exterior diameter of first section 32 of shaft 30. Second diameter "D2" is larger than the first diameter "D1" and larger than first section 32 of shaft 30. A groove 40*f* is defined in third region 40*c* and as will be seen later herein openings to three apertures 42, 44, and 46 are defined in groove 40*f*.

As best seen in FIG. 8, first end wall 22*b* of sleeve 22 may be beveled and the bevel may be oriented such that first end wall 22*b* is of a widest diameter proximate outer wall 22*a* and is of a smallest diameter proximate the opening to bore 40. Additionally, when sleeve 22 is viewed from the front (such as in FIG. 8), the beveled first end wall 22*b* angles upwardly and inwardly from outer wall 22*a*.

Second end wall 22*c* of sleeve 22 is substantially planar and oriented at right angles to a longitudinal axis 'y' (FIGS. 7 and 8) of sleeve 22, where the longitudinal axis 'y' extends from first end wall 22*b* to second end wall 22*c*. An annular notch 22*d* may be defined in outer wall proximate second end wall 22*c*. As a result, a relatively short region of outer wall 22*a* proximate second end wall 22*c* is of a reduced diameter relative to a remaining portion of outer wall 22*a*. An annular chamfered surface 22*e* (FIG. 11) may be defined in second wall 22*c* and chamfered surface 22*e* may circumscribe and define the opening to bore 40. The chamfered surface 22*e* angles upwardly and inwardly into bore 40.

Outer wall 22*a* of sleeve 22 defines therein a first aperture 42, a second aperture 44, and a third aperture 46. First, second and third apertures 42, 44, 46 are located in a region a short distance downwardly from first end wall 22*b*. As best seen in FIG. 8, first aperture 42, second aperture 44, and third aperture 22*c* are located in a same plane and that plane is oriented at right angles to longitudinal axis 'y'. Each of the first aperture 42, second aperture 44, and third aperture 46 originates in the exterior surface of wall 22*a* and terminates in third region 40*c* of bore 40. Each of the first, second and third apertures 42, 44, 46 thereby placed in fluid communication with bore 40. Furthermore, the first, second and third apertures 42, 44, 46 are located equidistantly from each other around the circumference of wall 22*a*. This can be seen in FIG. 9 where it is illustrated that adjacent apertures (such as first and second apertures 42 and 44; or second and third apertures 44 and 46; or first and third apertures 42 and 46) are located at an angle α (FIG. 9) relative to each other. The angle α is an angle of about 120°. Each of the first, second and third apertures 42, 44 and 46 form channels of substantially constant diameter from the exterior surface of outer wall 22*a* to bore 40.

First end wall 22*b* of sleeve 22 defines a first end aperture 48, a second end aperture 50, and a third end aperture 52 therein. Each of these end apertures 48, 50, and 52 originates in an exterior surface of first end wall 22*b* and extends inwardly and terminates in second region 40*b* of 40. The openings to first, second and third end apertures 48, 50, 52 defined in first end wall 22*b* are located substantially equidistantly from each other around the circumference of first end wall 22*b*. The openings to adjacent end apertures (such as first and second end apertures 48 and 59; or second and third end apertures 50 and 52; or first and third end apertures 48 and 52) are located at an angle β relative to each other. The angle β is about 120°.

As best seen in FIG. 8, each of the end apertures 48, 50 and 52 is substantially identical in configuration and comprises a first section 48*a*, 50*a* or 52*a*, respectively, that is of a first diameter "D4" and a second section 48*b*, 50*b* or 52*b*, respectively, that is of a second diameter "D5". The second diameter 'D5" is smaller than the first diameter "D4". Additionally, first section 48*a*, 50*a*, or 52*a*, respectively, is of a first length "L1" and second section 48*b*, 50*b* or 52*b*, respectively, is of a second length "L2". The second length "L2" is longer than the first length "L1". First end aperture 48 by way of example comprises first section 48*a* of first diameter "D4" and a first length "L1", and a second section 48*b* of second diameter "D5" and a second length "L2". The second section 48*a* forms a tube that terminates in third region 40*c* of bore 40 and thereby places first end aperture 48 in fluid communication with bore 40.

Figure 9:
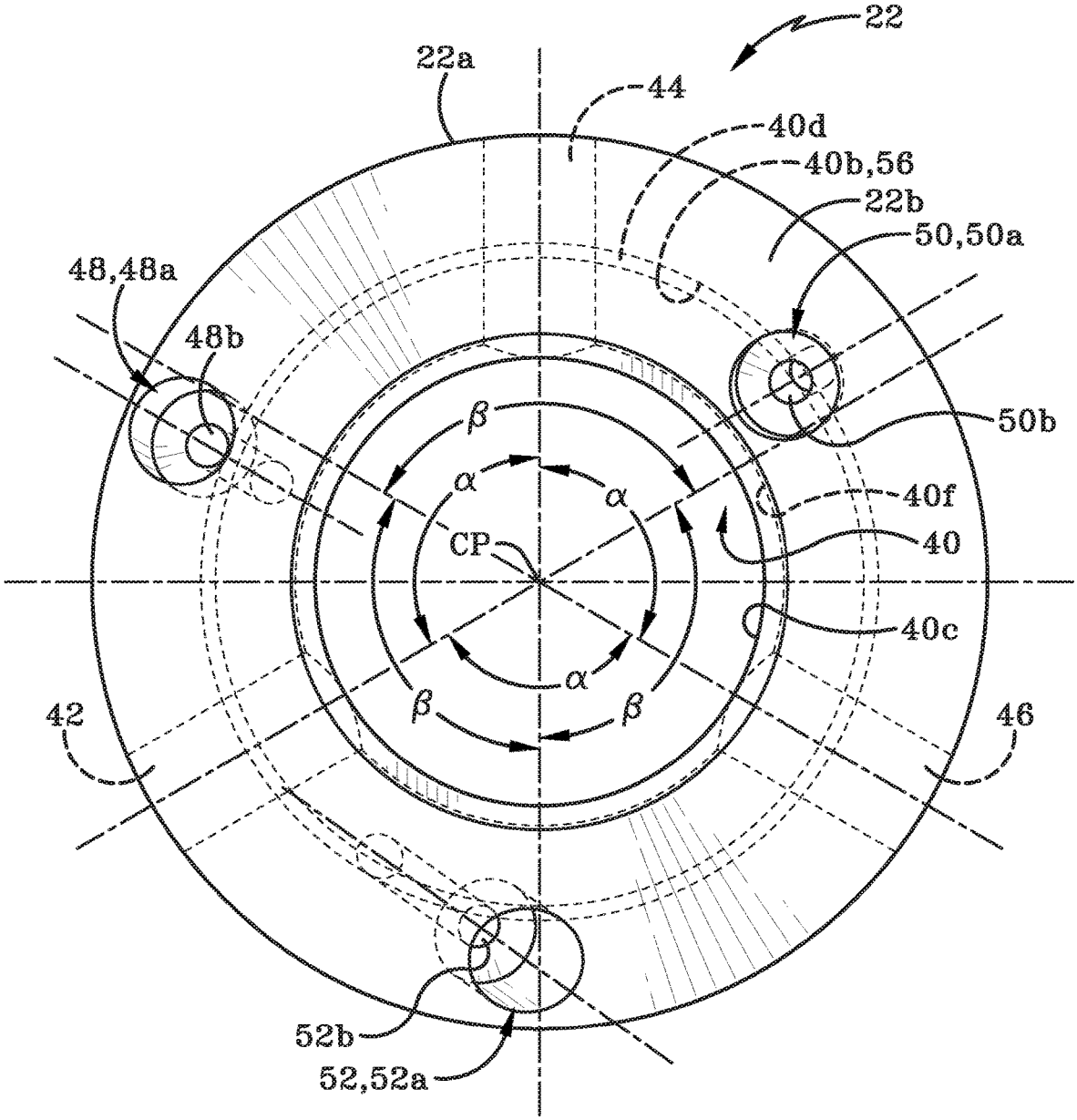
FIG. 9 is a top plan view of the sleeve of FIG. 7 showing the placement and orientation of the various apertures in the exterior wall of the sleeve.
Figure 9A:
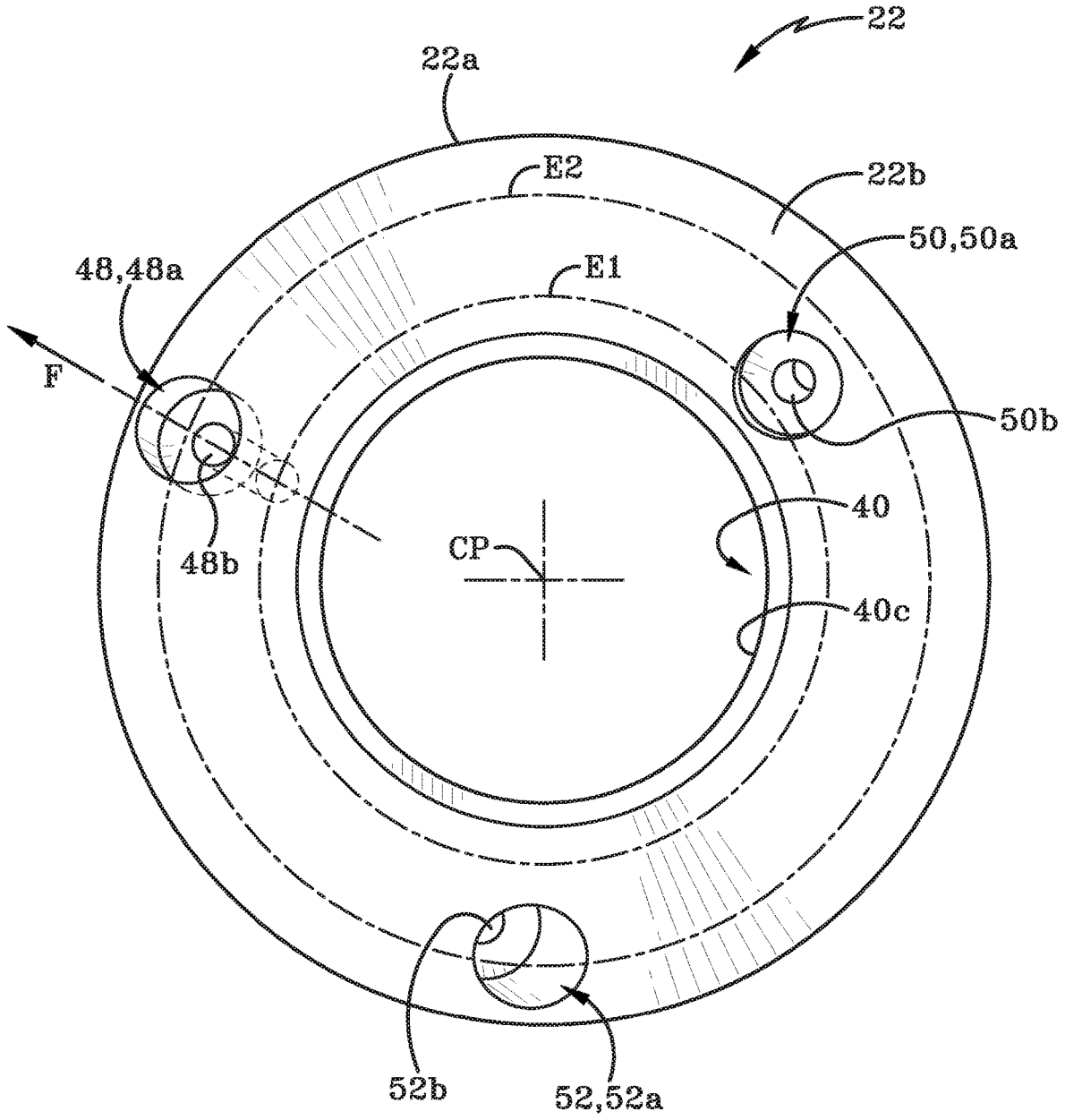
FIG. 9A is a top plan view of the sleeve of FIG. 7 detailing the orientation of the various regions of the first end aperture.
Figure 9B:
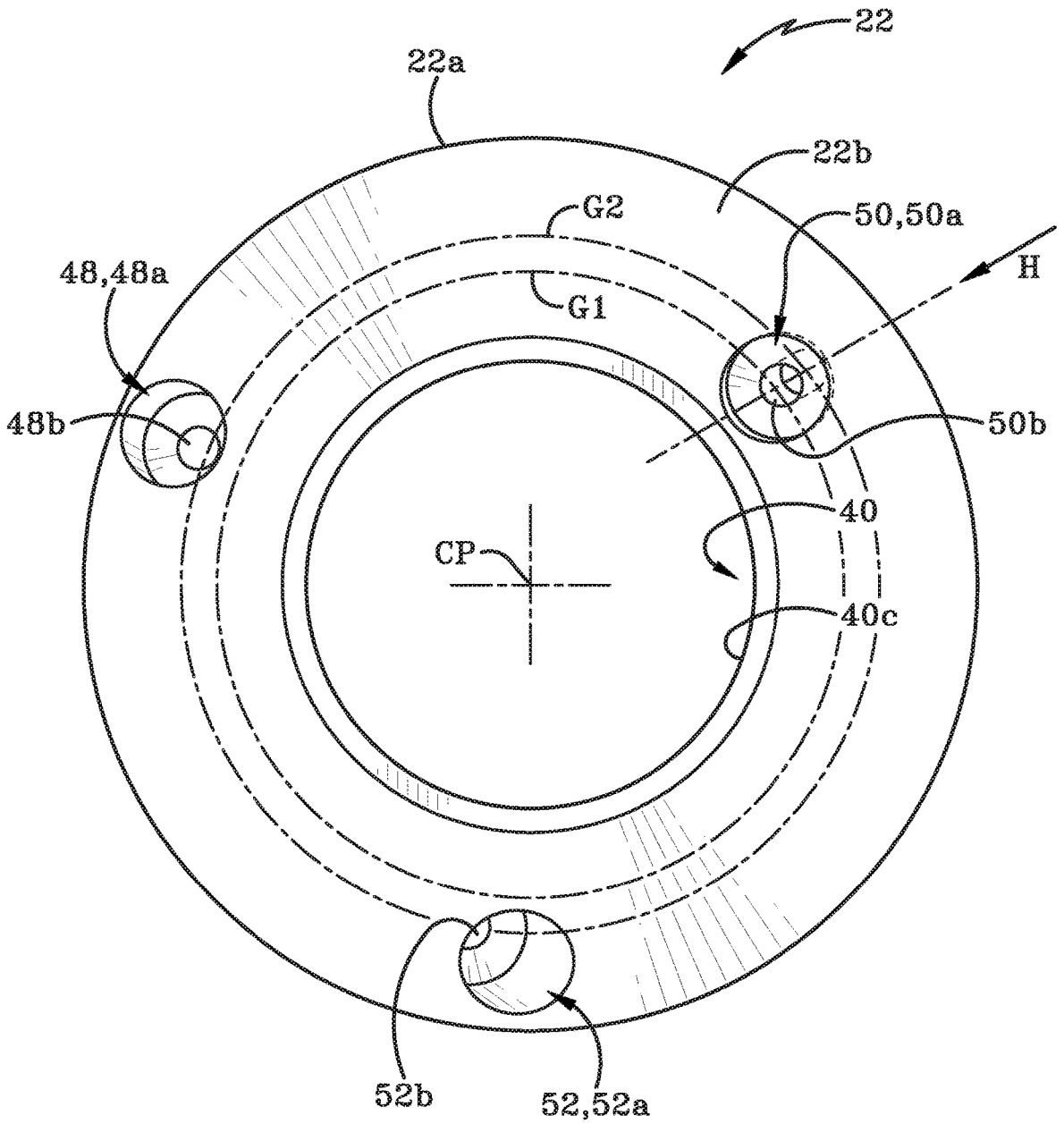
FIG. 9B is a top plan view of the sleeve of FIG. 7 detailing the orientation of the various regions of the second end aperture.
Figure 9C:
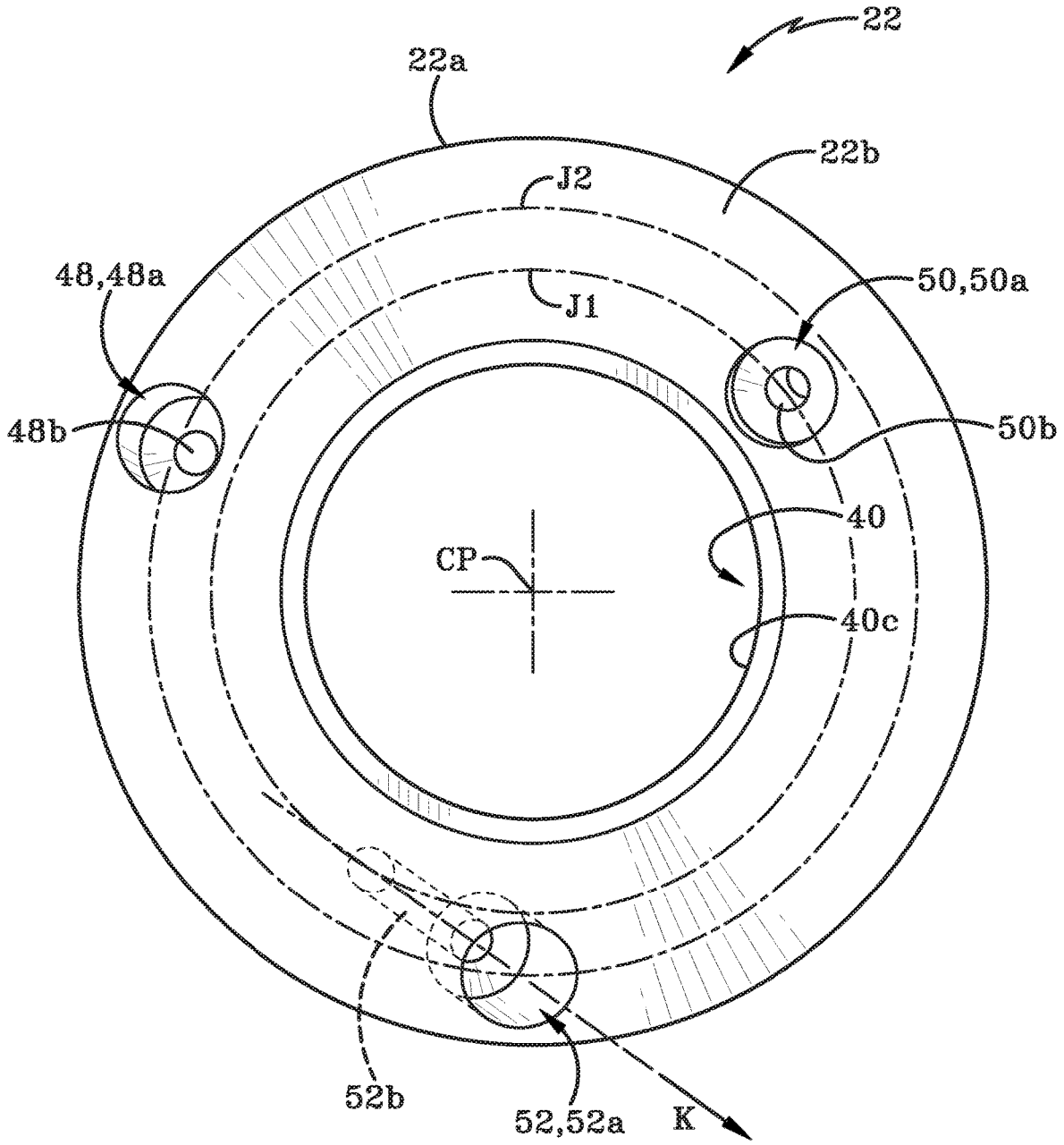
FIG. 9C is a top plan view of the sleeve of FIG. 7 detailing the orientation of the various regions of the third end aperture.

In accordance with an aspect of the present disclosure the first, second and third end apertures 48, 50 and 52 are not all oriented at the same angle relative to bore 40. FIGS. 9A, 9B, and 9C are provided to show the orientation of each of the first, second and third end apertures 48, 50, 52. Referring to FIG. 9A, first end aperture 48 is shown in greater detail. An imaginary first circumferential line "E1" and an imaginary second circumferential line "E2" are illustrated in FIG. 9A. Imaginary line "E1" passes through a center point of the opening of second section 48*b* of first end aperture 48 into bore 40. Imaginary line "E2" passes through a center point of the opening of first section 48*a* of first end aperture 48 in first end wall 22*b*. It can be seen that imaginary line "E2" is located further circumferentially outwardly from a center point "CP" of bore 40 relative to imaginary line "E1". As will be understood, first end aperture 48 thus angles outwardly from its opening into bore 40 to its opening in first end wall 22*b*. Thus, when water is flowing through bore 40 and subsequently through first end aperture 48, that water will spray out of the opening in first end wall 22*b* and in a direction angling outwardly away from bore 40 and beyond outer wall 22*a*. That direction is indicated by the arrow "F" in FIG. 9A and in FIG. 14.

Referring to FIG. 9B, second end aperture 50 is shown in greater detail. An imaginary first circumferential line "G1" and an imaginary second circumferential line "G2" are illustrated in FIG. 9B. Imaginary line "G2" passes through a center point of the opening of second section 50*b* of second end aperture 50 into bore 40. Imaginary line "G1" passes through a center point of the opening of first section 50*a* of second end aperture 50 in first end wall 22*b*. It can be seen that imaginary line "G2" is located further circumferentially outwardly from the center point "CP" of bore 40 relative to imaginary line "G1". As will be understood, second end aperture 50 thus angles inwardly from its opening into bore 40 to its opening in first end wall 22*b*. Thus, when water is flowing through bore 40 and subsequently through second end aperture 50, that water will spray out of the opening in first end wall 22*b* and in a direction angling inwardly towards bore 40 and inwardly away from outer wall 22*a*. That direction is indicated by the arrow "H" in FIG. 9B and in FIG. 14.

Referring to FIG. 9C, third end aperture 52 is shown in greater detail. An imaginary first circumferential line "J1" and an imaginary second circumferential line "J2" are illustrated in FIG. 9C. Imaginary line "J1" passes through a center point of the opening of second section 52*b* of third end aperture 52 into bore 40. Imaginary line "J2" passes through a center point of the opening of first section 52*a* of third end aperture 52 in first end wall 22*b*. It can be seen that imaginary line "J2" is located further circumferentially outwardly from a center point "CP" of bore 40 relative to imaginary line "J1". As will be understood, third end aperture 52 thus angles outwardly from its opening into bore 40 to its opening in first end wall 22*b*. Thus, when water is flowing through bore 40 and subsequently through third end aperture 52, that water will spray out of the opening in first end wall 22*b* and in a direction angling outwardly away from bore 40 and beyond outer wall 22*a*. That direction is indicated by the arrow "K" in FIG. 9C and in FIG. 14.

As shown in FIG. 8, the third end aperture 52 is oriented at an angle θ relative to an imaginary line "M" that is parallel to longitudinal axis 'y'. The orientation of third end aperture 52 is such that water flowing out therefrom in the direction of arrows "K" will cause sleeve 22 to rotate about shaft 30. The faster water flows out of third end aperture 52, the faster sleeve 22 rotates about longitudinal axis "Y".

Referring to FIGS. 3, and 10, nose cone 24 comprises a wall 24*a*, a first end wall 24*b*, and a second end wall 24*c*. A bore 24*d* extends from an opening in first end wall 24*b* to an opening in second end wall 24*c*. The interior surface of wall 24*a* that bounds and defines bore 24*d* is threaded with threads 24*e*. Threads 24*e* are configured to threadably engage with threads 34*a* on second section 34 of shaft 30 of body 20. Wall 24*a* tapers in diameter from first end wall 24*b* to second end wall 24*c*. A generally inverted V-shaped depression 24*f* is defined in outer wall 24*a*.

FIG. 10 shows nozzle 16 fully assembled. Shaft 30 of body 20 is inserted through the hole 26*a* defined in washer 26. Shaft 30 is then inserted into bore 40 of sleeve 22 through the opening defined in second end wall 22*c*. First section 32 of shaft 30 is retained within bore 40 of sleeve 22. Second and third regions 34, 36 of shaft 30 extend outwardly for a distance from first end wall 22*b* of sleeve 22. Third section 36 of shaft 30 is then inserted into the opening defined by second end 24*c* of nose cone 24 and into bore 24*d* thereof. Threads 24*e* of nose cone 24 are threadably engaged with threads 34*a* on second section 34 of shaft 30. Nose cone 24 is rotated until second end 24*c* thereof is located immediately above first end wall 22*b* of sleeve 22. Nose cone 24 is utilized as a nut to keep the body 20, washer 26 and sleeve 22 engaged with each other and prevents sleeve 2 from sliding off shaft 30.

As is evident from FIG. 10, when nozzle 16 is assembled, washer 26 is seated between second end wall 22*c* of sleeve 22 and first end wall 28*b* of base 28. The aperture 26*a* in washer 26 is large enough to circumscribe shaft 30 but is too small to be seated within notch 22*d* of sleeve. Washer 26 therefore acts as a spacer between first end wall 28*b* of base 28 and second end wall 22*c* of sleeve 22. Additionally, there is a gap 54 defined between second end 24*c* of nose cone 24 and first end wall 22*b* of sleeve 22. The presence of washer 26 and gap 54 ensures that sleeve will be able to rotate freely about shaft 30 during operation of nozzle 16.

Figure 11:
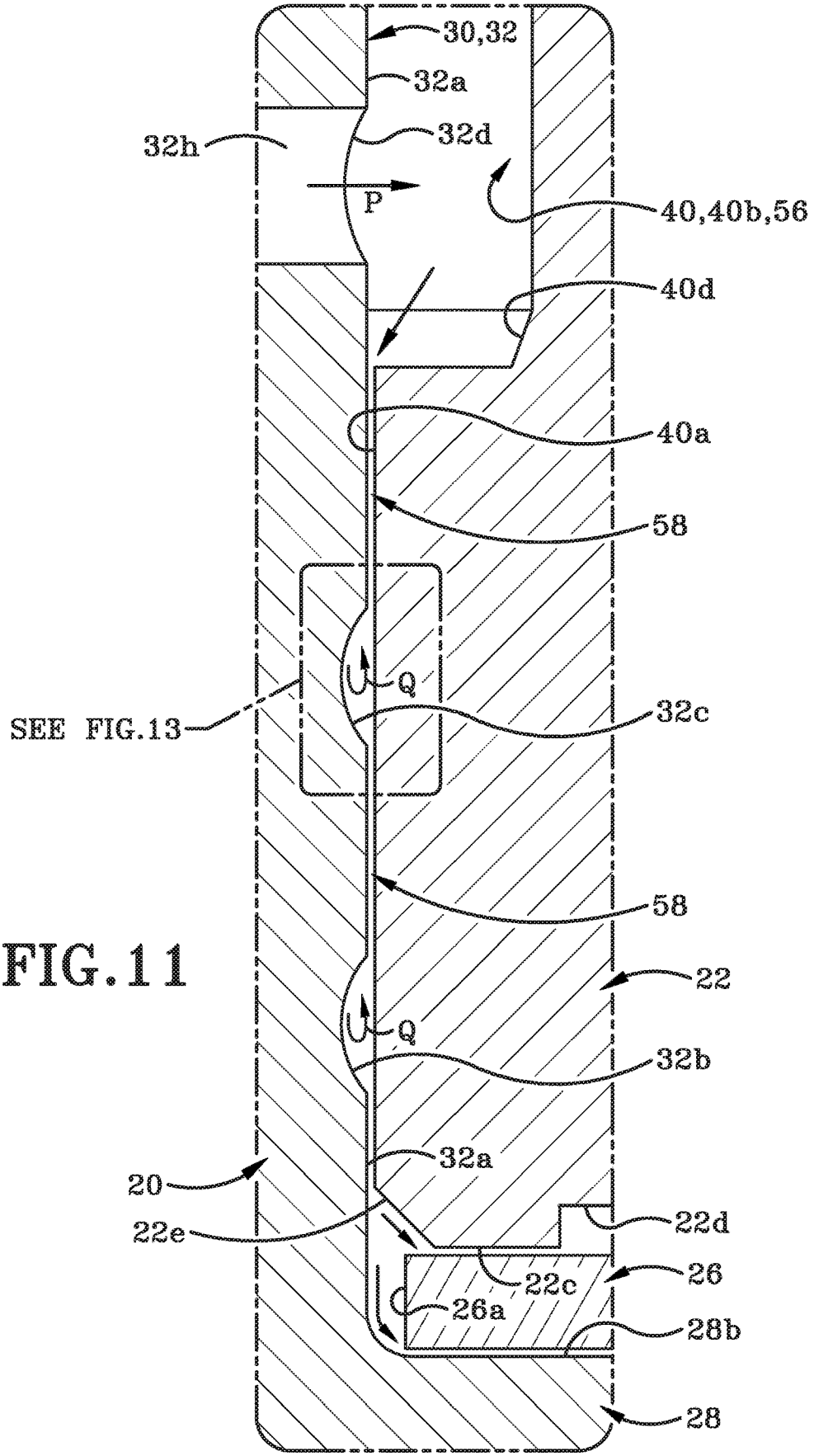
FIG. 11 is an enlargement of the highlighted region of FIG. 10 entitled "See FIG. 11"
Figure 12:
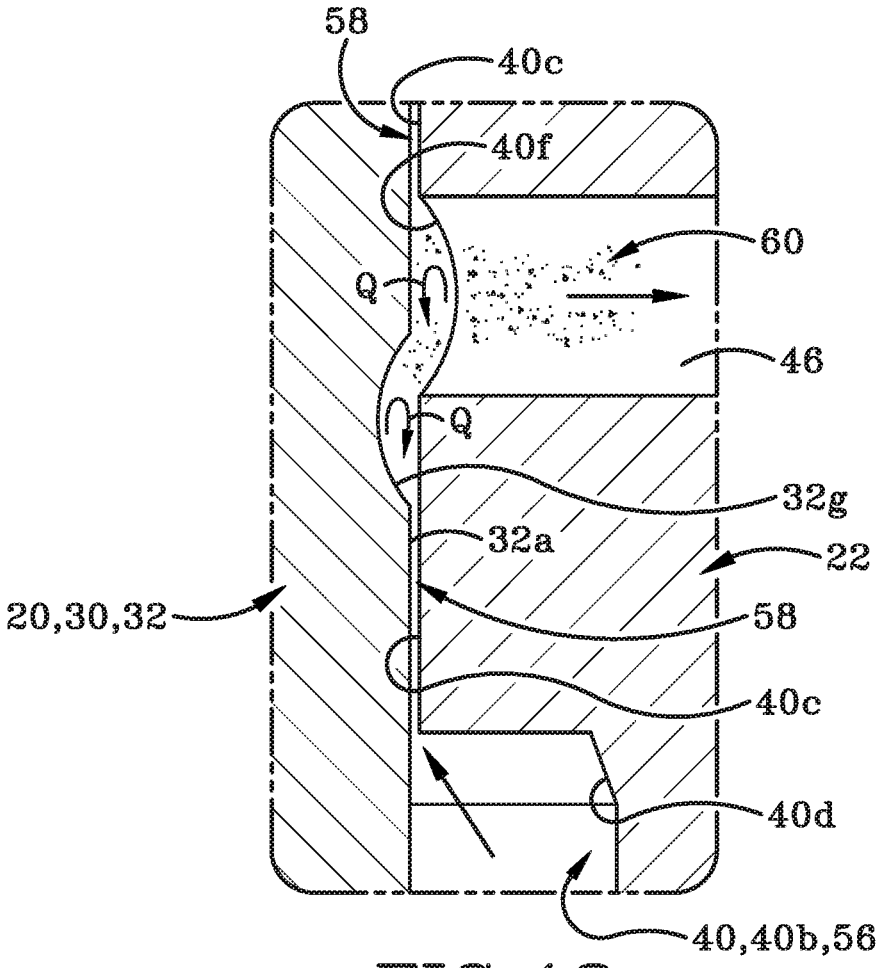
FIG. 12 is an enlargement of the highlighted region of FIG. 10 entitled "See FIG. 12"
Figure 13:
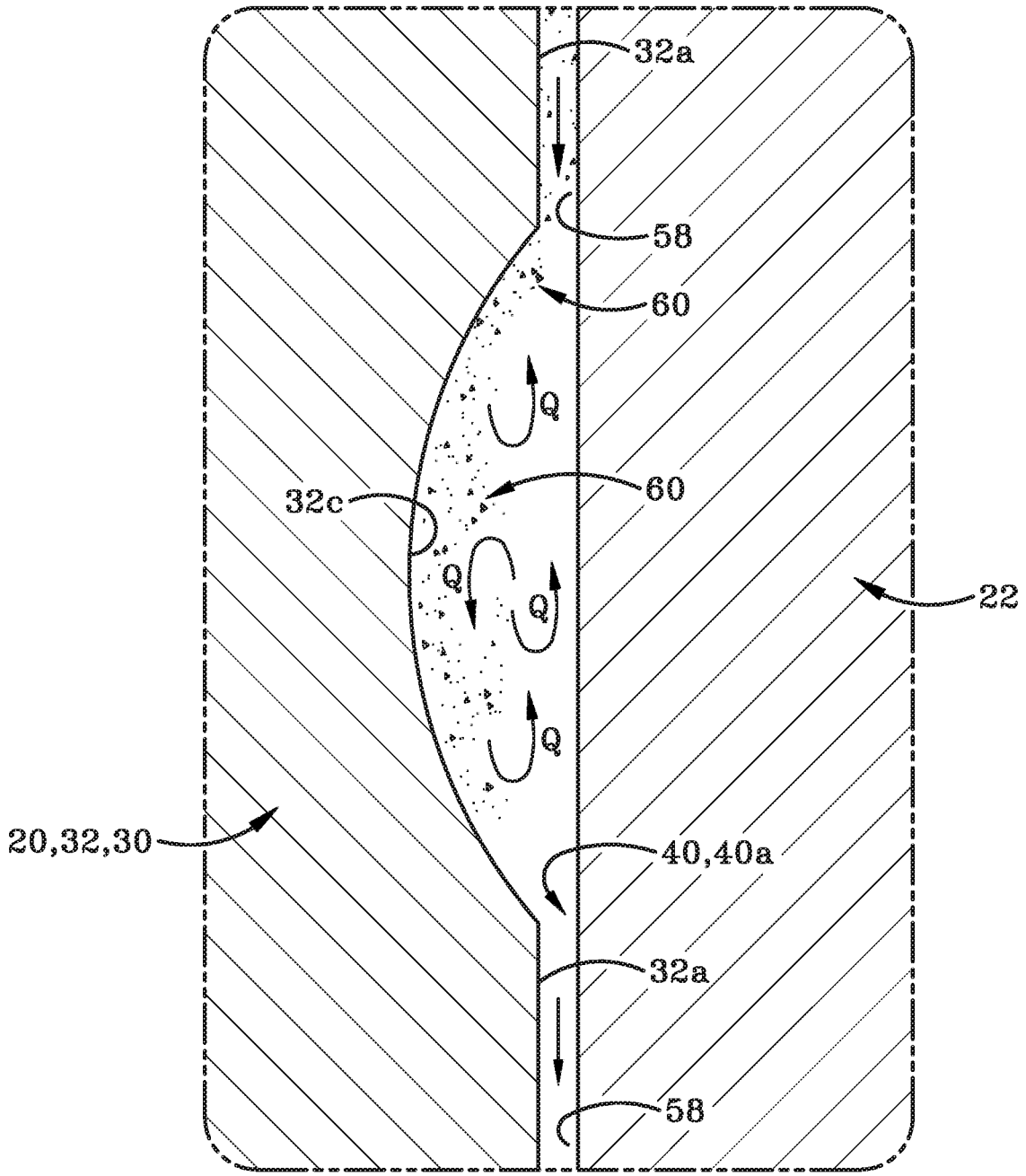
FIG. 13 is an enlargement of the highlighted region of FIG. 11 entitled "See FIG. 13"

FIGS. 10-13 also show that a chamber 56 is defined between the exterior surface 32*a* of first section 32 of shaft 30 and the interior surface of sleeve 22 that defines second region 40*b* of bore 40. FIG. 11 shows that a space 58 is defined between exterior surface 32 of shaft 30 and the interior surface of sleeve that defines first region 40*a* and third region 40*c* of bore 40. Chamber 56, space 58, and all of the annular grooves 32*b*, 32*c*, 32*d*, 32*e*, 32*f* and 32*g* and bore 38*c* are all in fluid communication with each other. Additionally, because apertures 42, 44, 46 extend from third region 40*c* of bore 40 through to exterior surface 22*a* of sleeve 22, apertures 42, 44, 46 are also in fluid communication with chamber 56, space 58, grooves 32*b*-32*g* and bore 38*c*. Still further, because first, second and third end apertures 48, 50 and 52 extend from openings into second region 40*b* of bore 40 to first end wall 22*b*, first, second and third end apertures 48 50 and 52 are in fluid communication with chamber 56, space 58, annular grooves 32*b*-32*g* and bore 38*c*. Finally, space 58 is open at a first end proximate washer 26 and at a second end proximate nose cone 24.

Washer arm 14 is threadably engaged with the threads 38*d* of base 28 to engaged nozzle 16 with washer arm 14. When a remote water supply is activated, water flows from a bore defined in washer arm 14 into bore 38 of body 20. This water flow is indicated by arrow "N" in FIG. 10. As water flows through bore 38, some of the water will be diverted into each of the apertures 32*h* (as indicated by arrows "P") and thereby into and along the associated grooves 32*b*-32*g* and subsequently into space 58 and chamber 56. As chamber 56 fills up, water will begin to flow out of first, second and third end apertures 48, 50 and 52. When the water flowing through space 58 reaches first, second and third apertures 42, 44, 46, water will flow out of those apertures and into the environment surrounding nozzle 16.

Since shaft 30 is fixedly connected to washer arm 14, shaft 30 remains stationary and sleeve 22 rotates about shaft 30 in the direction indicated by arrow "R" in FIG. 1. The rotation of sleeve 22 is caused by water flowing rapidly out of third end aperture 52. Water in space 58 and in chamber 56 acts as a water bearing that enables sleeve 22 to freely rotate about shaft 30.

Since water is delivered from washer arm 14 to nozzle 16 under high pressure some of the water in space 58 will tend to forced out of the top end and bottom end of space 58, i.e., proximate nose cone 24 and proximate washer 26. This leakage is slowed relative to prior art nozzles. Typically, the rate of leakage from PRIOR ART nozzles would be in the range of about eight gallons per minute. FIGS. 10-13 shows water flowing from apertures 32*h* and into space 58. Small vortices are created in the water moving through space 58 wherever that water encounters one of the grooves 32*b*-32*g*. The vortices create turbulence (indicated by arrows "Q") in the water and this turbulence tends to slow the rate of water leakage from the top end and bottom end of space 58. The rate of leakage from nozzle 16 is in the range of about one and half gallons per minute as opposed to the around eight gallons per minute of PRIOR ART nozzles. The decrease in water leakage in the present nozzle 16 is thus substantial.

The turbulence created by the presence of grooves 32*b*-32*g* and by groove 40*f* defined in sleeve 22 helps to remove any small particulates 60 entrained in the water flowing through nozzle to become trapped in the grooves 32*g*-32*g*. The turbulence causes some of these small particulate materials to simply circulate in grooves 32*b*-32*g* or to flow out of the first, second or third apertures 42, 44, 46 with water that works its way through space 58 to third region 40*c* of bore 40. This entrapment of removal of particulate materials 60 helps ensure that these particulates will not lodge between the rotating sleeve 22 and the stationary shaft 30. If particulates become lodged in space 58 they may prevent sleeve 22 from rotating properly and therefore stop cleaning as efficiently.

Figure 14:
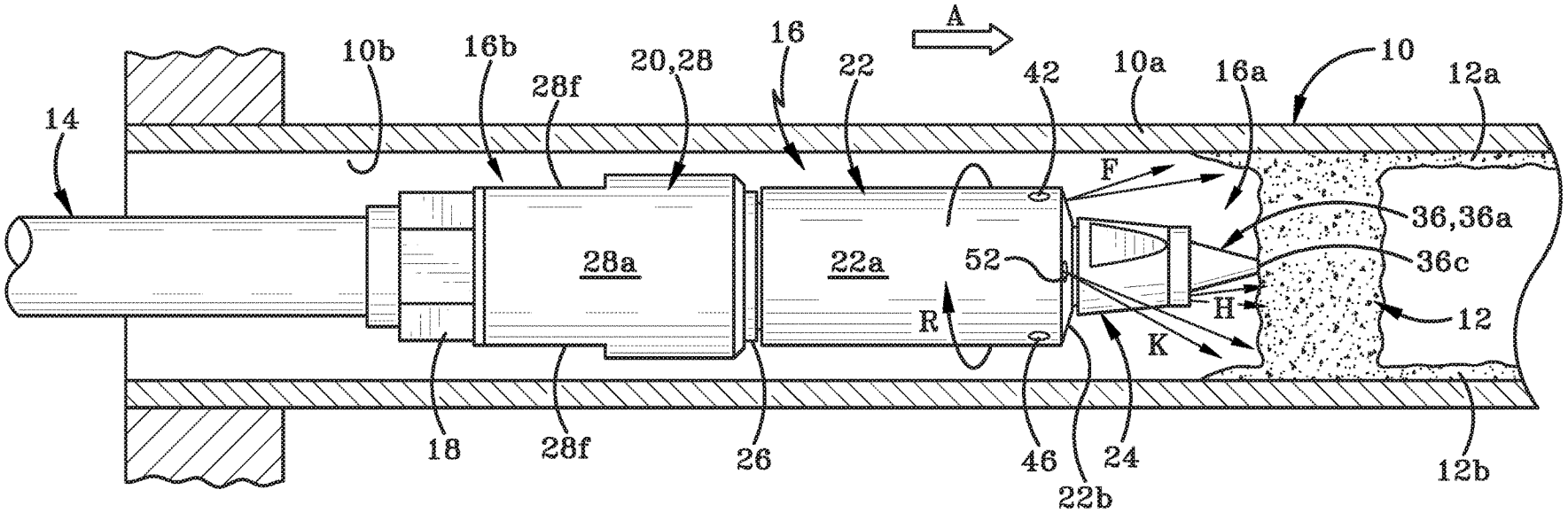
FIG. 14 is a front elevation view of the nozzle rotating within a clogged pipe.
Figure 15:
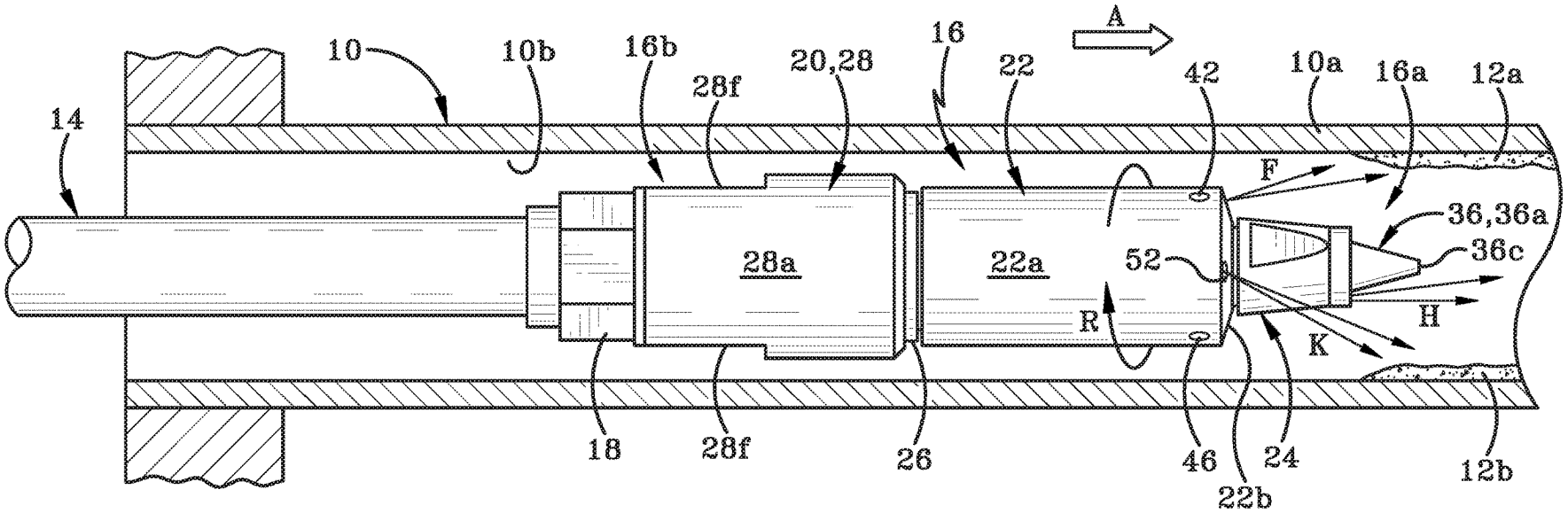
FIG. 15 is a front elevational view of the nozzle rotating within the pipe having cleared away at least part of the clogged region.

Referring to FIGS. 14 and 15, the washing arm 14 is inserted into bore 10*b* of tube 10 and is advanced in the direction of arrow "A" through bore 10*b*. As washing arm 14 is moved in this direction, sleeve 22 rotates about the longitudinal axis "Y" (FIG. 10) of nozzle 16 in the direction indicated by arrow "R". (It should be noted that sleeve 22 may, alternatively, rotate in the opposite direction to arrow "R" in other embodiments of the nozzle in accordance with the present disclosure.) Rotation of sleeve 22 is caused by the flow of pressurized water through the angled third end aperture 52. Not only does the flow of water out of third end aperture 52 rotate sleeve 22, but the high pressure water jet from third end aperture 52 also contacts the interior surface of tube 10 and scours deposited material therefrom. At the same time, a high pressure water jet flows out of first end aperture 58 and contacts and scours the interior surface of tube 10. Furthermore, a high pressure water jet flows out of second end aperture 50 towards tip 36*c* of third section 36. (It should be noted that second end aperture 50 may be oriented at an angle that is substantially the same as the angle of taper on the conical outer wall 36*a* of third section 36.) The high pressure water jet flowing out of second end aperture 50 helps lubricate the tube helps remove material that may be located in front of the advancing nozzle 16.

FIG. 14 shows a clog 12 entirely blocking tube 10. As washing arm 14 and the engaged nozzle 16 continue to move in the direction of arrow "A", tip 36*b* of third section 36 will run into clog 12. Tip 36*c* and third section 36 along with the water jet flowing from second end aperture 50 act as a battering ram on clog 12 to help break and flush away bits of material from in front of nozzle 16. The rotating water jets spraying out of first end aperture 48 and third end aperture 52 clear away built up material from the interior surface of tube 10. FIG. 15 shows that clog 12 has been broken up and flushed away by nozzle 16 and the water jets spraying out of first end aperture 48 and third end aperture 52 are scouring away the rest of the built up material 12*a*, 12*b* from the interior surface of tube 10. The section of tube 10 through which nozzle 16 has already passed is free of built up material and clogs.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A nozzle for engagement with a washing arm; said nozzle comprising:

a body including:

a base having a first end and a second end and having a longitudinal axis extending therebetween; said second end of the base being adapted to be engaged with an end of a washing arm; and a shaft having a first section that extends longitudinally outwardly from the first end of the base;

wherein the base defines a bore that originates in the second end and extends for a distance within the first section of the shaft;

wherein an exterior surface of the first section of the shaft defines at least one opening therein that is in fluid communication with the bore; and wherein the exterior surface of the first section of the shaft defines one or more grooves therein and the at least one opening is in fluid communication with one of the one or more grooves.

2. The nozzle as defined in claim 1, further comprising:

a sleeve mounted for rotation about the first section of the shaft.

3. The nozzle as defined in claim 2, wherein the sleeve is tubular and has an outer wall with a first end and a second end and a longitudinal axis extending therebetween; wherein the outer wall defines a bore therein that extends between the first and second ends of the sleeve.

4. The nozzle as defined in claim 3, wherein the bore of the sleeve includes a first region, a second region, and a third region; wherein the second region is located between the first region and the third region; and wherein both of the first region and the third region are of a first diameter and the second region is of a second diameter, and the second diameter is greater than the first diameter.

5. The nozzle as defined in claim 4, wherein the first diameter is of a size that approximates an external diameter of the first section of the shaft.

6. The nozzle as defined in claim 3, wherein the one or more grooves defined in the first section of the shaft are placed in fluid communication with the bore of the sleeve when the sleeve is engaged for rotation about the first section of the shaft.

7. The nozzle as defined in claim 3, wherein the outer wall of the sleeve defines at least one opening that is in fluid communication with the bore of the sleeve.

8. The nozzle as defined in claim 7, wherein each at least one opening is oriented at right angles to the longitudinal axis of the sleeve.

9. The nozzle as defined in claim 3, wherein the first end of the sleeve defines a first end aperture, a second end aperture and a third end aperture therein; and wherein the first end aperture, second end aperture and third end aperture are in fluid communication with the bore of the sleeve.

10. The nozzle as defined in claim 9, wherein the first end aperture is oriented at an angle relative to the longitudinal axis of the sleeve, and the first end aperture is oriented so as to direct water from the bore of the sleeve outwardly beyond an exterior surface of the outer wall of the sleeve.

11. The nozzle as defined in claim 9, wherein the second end aperture is oriented at an angle relative to the longitudinal axis of the sleeve; and the second end aperture is oriented so as to direct water from the bore of the sleeve inwardly toward the longitudinal axis of the sleeve and toward a tip of the shaft that projects outwardly from the first end of the sleeve.

12. The nozzle as defined in claim 9, wherein the third end aperture is oriented at an angle relative to the longitudinal axis of the sleeve; and wherein the second end aperture is oriented so as to direct water from the bore of the sleeve outwardly beyond an exterior surface of the outer wall of the sleeve; and wherein water flowing out of the third end aperture causes rotation of the sleeve about the shaft.

13. The nozzle as defined in claim 1, wherein each of the one or more grooves is an annular groove.

14. The nozzle as defined in claim 1, wherein each of the one or more grooves is oriented at right angles to the longitudinal axis of the base.

15. The nozzle as defined in claim 1, wherein the shaft further comprises a second section that extends outwardly from the first section; and wherein the second section is externally threaded with threads.

16. The nozzle as defined in claim 15, further comprising a nose cone that is internally threaded and is selectively engageable with the second section of the shaft.

17. The nozzle as defined in claim 15, wherein the shaft further comprises a third section that extends outwardly from the second section; and the third section has an exterior surface that is smooth.

18. The nozzle as defined in claim 17, wherein the third section tapers in external diameter and terminates in a tip.

19. The nozzle as defined in claim 18, wherein the tip is free of openings.

20. The nozzle as defined in claim 17, wherein the third section has a truncated conical shape.

* * * * *